US009953613B2

(12) United States Patent
Sacchetto et al.

(10) Patent No.: US 9,953,613 B2
(45) Date of Patent: Apr. 24, 2018

(54) HIGH SPEED DISPLAY INTERFACE

(71) Applicant: APPLE INC., Cupertino, CA (US)

(72) Inventors: Paolo Sacchetto, Cupertino, CA (US); David W. Lum, Cupertino, CA (US); Christopher P. Tann, San Jose, CA (US); Guy Cote, San Jose, CA (US); Chaohao Wang, Sunnyvale, CA (US); Sandro H. Pintz, Menlo Park, CA (US)

(73) Assignee: APPLE INC., Cupertino, CA (US)

( * ) Notice: Subject to any disclaimer, the term of this patent is extended or adjusted under 35 U.S.C. 154(b) by 74 days.

(21) Appl. No.: 14/661,723

(22) Filed: Mar. 18, 2015

(65) Prior Publication Data

US 2016/0275905 A1 Sep. 22, 2016

(51) Int. Cl.
*G09G 5/00* (2006.01)

(52) U.S. Cl.
CPC ..... *G09G 5/006* (2013.01); *G09G 2330/021* (2013.01); *G09G 2340/02* (2013.01); *G09G 2340/0435* (2013.01); *G09G 2350/00* (2013.01); *G09G 2370/10* (2013.01)

(58) Field of Classification Search
None
See application file for complete search history.

(56) References Cited

U.S. PATENT DOCUMENTS 5,936,616 A * 8/1999 Torborg, Jr. ..... G06F 12/0875 345/545
6,469,744 B1 * 10/2002 Pearlstein ..... G06F 3/14 348/497
8,059,673 B2 11/2011 Kobayashi
8,400,567 B2 3/2013 Lee et al.
8,615,611 B2 12/2013 Hall
8,861,516 B2 10/2014 Oren et al.
2003/0128198 A1 * 7/2003 Mizuyabu ..... G06F 1/3203 345/204
2011/0234608 A1 * 9/2011 Funada ..... G09G 5/391 345/545

(Continued)

FOREIGN PATENT DOCUMENTS

EP 2800393 11/2014
JP 2001-184038 A 7/2001

(Continued)

OTHER PUBLICATIONS

Partial International Search Report for PCT Application No. PCT/US2016/019345 dated Jun. 1, 2016; 6 pgs.

*Primary Examiner* — Yi Wang
(74) *Attorney, Agent, or Firm* — Fletcher Yoder PC

(57) ABSTRACT

Methods and devices employing circuitry for dynamically adjusting bandwidth control of a display interface are provided. The display interface or image content is dynamically adjusted to support both high-speed image data (e.g., 120 Hz image data) and lower-speed content (e.g., 60 Hz content). For example, in some embodiments, additional pixel pipelines and/or processing lanes may be activated during the rendering of high-speed image data, but not during the rendering of low-speed image data. Additionally or alternatively, high-speed image data, but not low-speed data, may be compressed to render high-speed content over an interface that supports only low-speed content.

29 Claims, 12 Drawing Sheets

(56) References Cited

U.S. PATENT DOCUMENTS

| | | | | |
|---|---|---|---|---|
| 2011/0310296 | A1* | 12/2011 | Lee | G09G 5/008 348/539 |
| 2013/0036335 | A1* | 2/2013 | Kim | G09G 3/006 714/704 |
| 2014/0168187 | A1* | 6/2014 | Qu | G09G 3/20 345/212 |
| 2014/0218349 | A1 | 8/2014 | Vasquez et al. | |
| 2014/0267322 | A1 | 9/2014 | McVay et al. | |
| 2014/0327685 | A1 | 11/2014 | Lee et al. | |
| 2016/0078846 | A1* | 3/2016 | Liu | G09G 5/18 345/212 |
| 2017/0054984 | A1 | 2/2017 | Park et al. | |

FOREIGN PATENT DOCUMENTS

| | | | |
|---|---|---|---|
| JP | 2012-054700 | A | 3/2012 |
| KR | 10-2011-0137916 | A | 12/2011 |
| KR | 10-2014-0131102 | A | 11/2014 |
| KR | 10-2015-0126221 | A | 11/2015 |
| WO | 88/07250 | A2 | 9/1988 |

* cited by examiner

HIGH SPEED DISPLAY INTERFACE

BACKGROUND

The present disclosure relates generally to electronic devices and, more particularly, to reducing artifacts of high-bandwidth display interfaces of the electronic devices.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Organic light-emitting diode (OLED) displays and Liquid crystal displays (LCDs) are commonly used as screens or displays for a wide variety of electronic devices, including consumer electronics such as televisions, computers, and handheld devices (e.g., cellular telephones, audio and video players, gaming systems, and so forth). Such devices typically provide a flat display in a relatively thin package that is suitable for use in a variety of electronic goods.

Typically, LCD panels include an array of pixels for displaying images. Image data related to each pixel may be sent by a processor to the LCD panel through a driver integrated circuit (IC). The driver IC then processes the image data and transmits corresponding voltage signals to the individual pixels. As the resolution of these LCDs increase, an increased amount of data may be transferred from the processor to the LCD panel. Unfortunately, increasing data transfer bandwidth may be costly and/or result in display artifacts.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Embodiments of the present disclosure relate to devices and methods for reducing artifacts and/or costs of a high bandwidth display. By way of example, a method for reducing artifacts and/or costs of a high bandwidth display may include receiving an indication of a refresh rate of content to be displayed on the electronic device. Compression artifacts may be more observable in low-speed content than high-speed content. Accordingly, in some embodiments, based upon the refresh rate indication, the content may be selectively compressed. For example, low-speed content (e.g., 60 Hz or less) may be transferred for processing without compression, while higher-speed content (e.g., greater than 60 Hz, 120 Hz, etc.) may be compressed and then transferred for processing. In some embodiments, a number of transmission lanes and/or transmission pipelines may be activated, based upon the refresh rate indication. For example, more transmission pipelines and/or transmissions lanes may be activated for higher-speed content than low-speed content.

Various refinements of the features noted above may be made in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Figure 1:
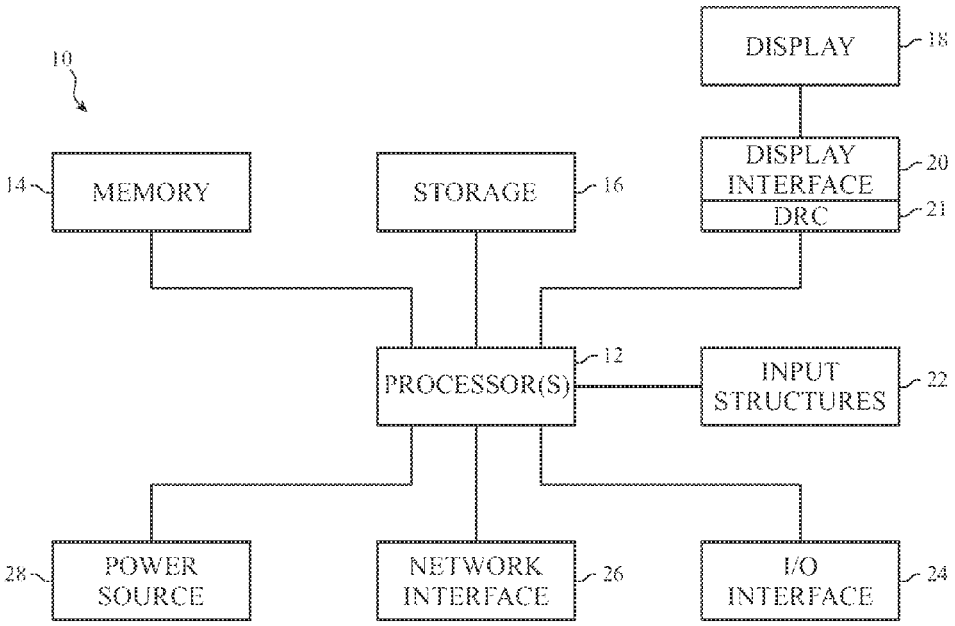
FIG. 1 is a block diagram of example components of an electronic device, in accordance with present embodiments.
Figure 2:
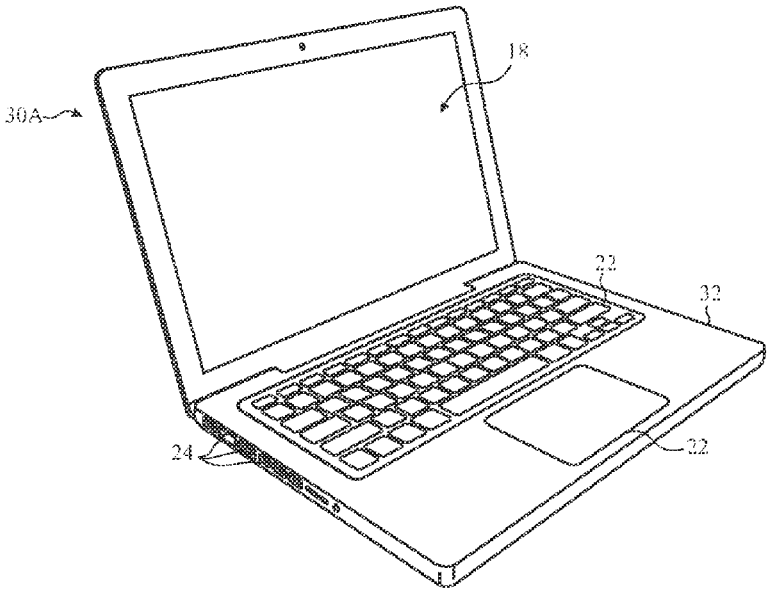
FIG. 2 is a perspective view of a notebook computer representing an embodiment of the electronic device of FIG. 1.
Figure 3:
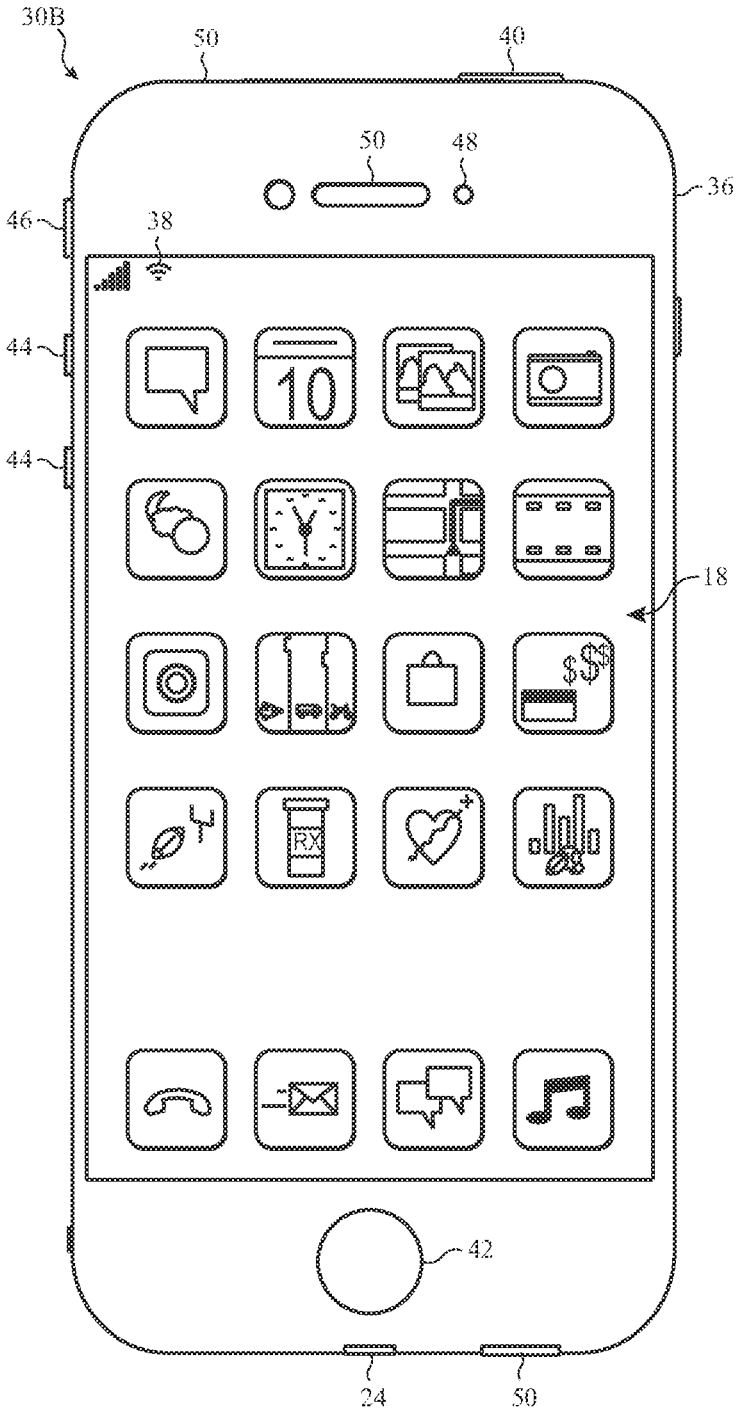
FIG. 3 is a front view of a handheld device representing another embodiment of the electronic device of FIG. 1.
Figure 4:
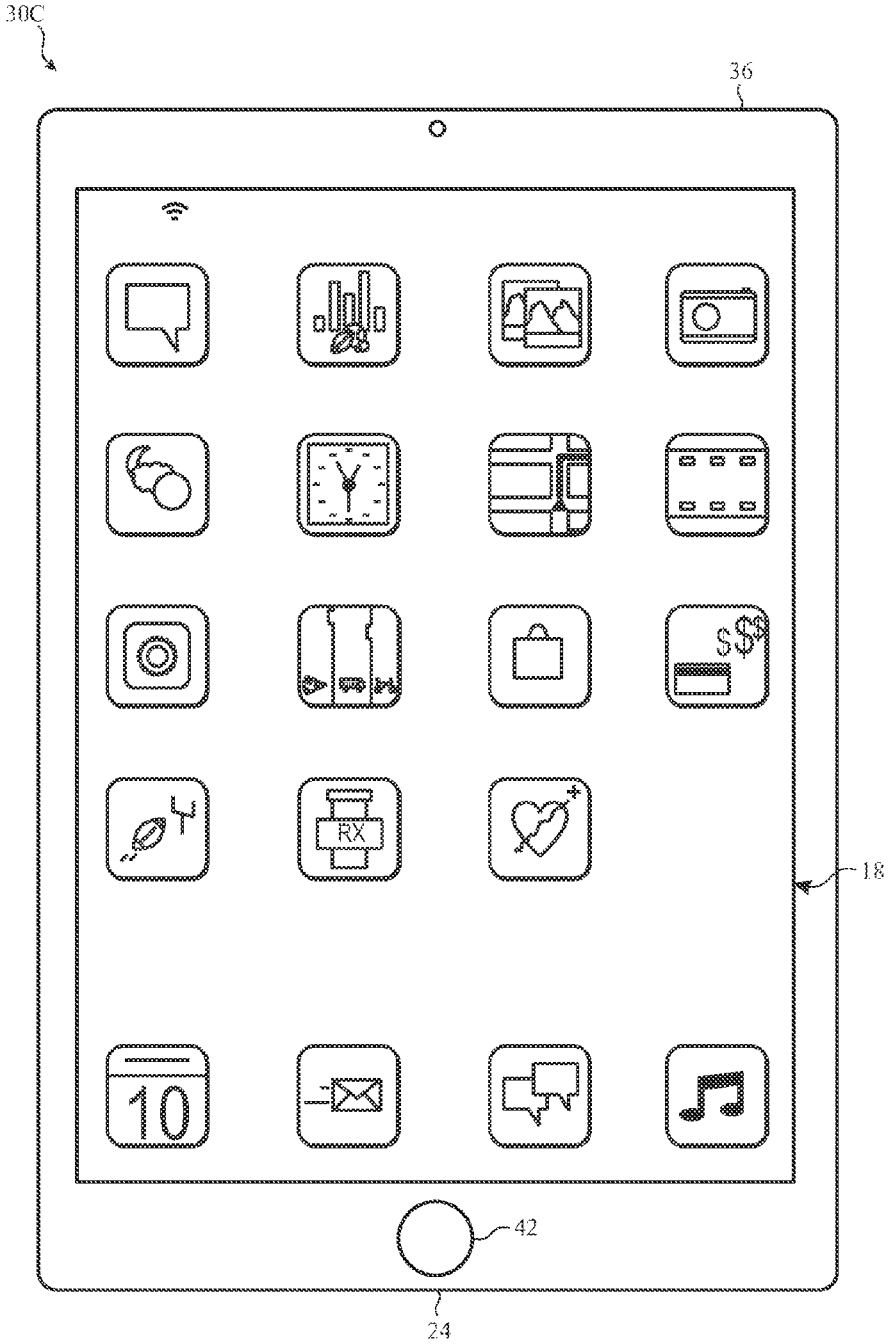
FIG. 4 is a front view of a tablet computing device representing another embodiment of the electronic device of FIG. 1.

With the foregoing in mind, a general description of suitable electronic devices that may employ touch-sensitive displays having capabilities to operate in a reduced power mode will be provided below. In particular, FIG. 1 is a block diagram depicting various components that may be present in an electronic device suitable for use with such a display. FIGS. 2, 3, and 4 respectively illustrate perspective and front views of a suitable electronic device, which may be, as illustrated, a notebook computer, handheld electronic device, or a tablet computing device.

Turning first to FIG. 1, an electronic device 10 according to an embodiment of the present disclosure may include, among other things, one or more processor(s) 12, memory 14, and nonvolatile storage 16. The display 18 may be communicatively coupled to the processor 12 via a display interface 20. Further, the electronic device 10 may be equipped with dynamic bandwidth control circuitry 21 (e.g., at the processor 12, the display interface 20, and/or the display 18). The electronic device may also include input structures 22, an input/output (I/O) interface 24, network interfaces 26, and a power source 28. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in the electronic device 10. As will be appreciated, when a touch-sensitive display is operating in a mode where the display does not need to be updated at a high frequency, an unnecessary amount of power may be consumed by the display. As such, embodiments of the present disclosure may be employed to decrease the power consumption of the touch-sensitive display.

By way of example, the electronic device 10 may represent a block diagram of the notebook computer depicted in FIG. 2, the handheld device depicted in FIG. 3, the tablet computing device depicted in FIG. 4, or similar devices. It should be noted that the processor(s) 12 and/or other data processing circuitry may be generally referred to herein as "data processing circuitry." This data processing circuitry may be embodied wholly or in part as software, firmware, hardware, or any combination thereof. Furthermore, the data processing circuitry may be a single contained processing module or may be incorporated wholly or partially within any of the other elements within the electronic device 10. As presented herein, circuitry may dynamically control a bandwidth of the display interface 21.

In the electronic device 10 of FIG. 1, the processor(s) 12 and/or other data processing circuitry may be operatively coupled with the memory 14 and the nonvolatile memory 16 to execute instructions. Such programs or instructions executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and optical discs. Also, programs (e.g., an operating system) encoded on such a computer program product may also include instructions that may be executed by the processor(s) 12.

The display 18 may be a touch-screen (e.g., touch-sensitive) liquid crystal display (LCD), for example, which may allow users to interact with a user interface of the electronic device 10. In some embodiments, the electronic display 18 may be a MultiTouch™ display that can detect multiple touches concurrently. For example, the display 18 may be a capacitive-touch-sensitive display capable of detecting projected capacitive touch (PCT) touch input gestures, such as a single touch, a double touch, a drag, a flick, a pinch, a rotate, a zoom, or combinations thereof. As will be described further detail, to reduce implementation costs (e.g., power savings) and/or reduce display 18 artifacts, the dynamic bandwidth control circuitry 21 may be used to control various aspects relating to content transmission to the display 18 based upon a refresh rate of the content.

The input structures 22 of the electronic device 10 may enable a user to interact with the electronic device 10 (e.g., pressing a button to increase or decrease a volume level). The I/O interface 24 may enable electronic device 10 to interface with various other electronic devices, as may the network interfaces 26. The network interfaces 26 may include, for example, interfaces for a personal area network (PAN), such as a Bluetooth network, for a local area network (LAN), such as an 802.11x Wi-Fi network, and/or for a wide area network (WAN), such as a 3G or 4G cellular network. The power source 28 of the electronic device 10 may be any suitable source of power, such as a rechargeable lithium polymer (Li-poly) battery and/or an alternating current (AC) power converter.

The electronic device 10 may take the form of a computer or other type of electronic device. Such computers may include computers that are generally portable (such as laptop, notebook, and tablet computers) as well as computers that are generally used in one place (such as conventional desktop computers, workstations and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 30A, is illustrated in FIG. 2 in accordance with one embodiment of the present disclosure. The depicted computer 30A may include a housing 32, a display 18, input structures 22, and ports of an I/O interface 24. In one embodiment, the input structures 22 (such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on the display 18. Further, the display 18 may include the dynamic bandwidth control circuitry 21, which may enable dynamic alterations of the transmission of content to the display 18 based upon a refresh rate of the content.

FIG. 3 depicts a front view of a handheld device 30B, which represents one embodiment of the electronic device 10. The handheld device 30B may represent, for example, a portable phone, a media player, a personal data organizer, a handheld game platform, or any combination of such devices. By way of example, the handheld device 30B may be a model of an iPod® or iPhone® available from Apple Inc. of Cupertino, Calif. In other embodiments, the electronic device 10 may also be a tablet computing device 30C, as illustrated in FIG. 4. For example, the tablet computing device 30C may be a model of an iPad® available from Apple Inc.

The handheld device 30B may include an enclosure 36 to protect interior components from physical damage and to shield them from electromagnetic interference. The enclosure 36 may surround the display 18, which may display indicator icons 38. The indicator icons 38 may indicate, among other things, a cellular signal strength, Bluetooth connection, and/or battery life. The I/O interfaces 24 may open through the enclosure 36 and may include, for example, a proprietary I/O port from Apple Inc. to connect to external devices.

User input structures 40, 42, 44, and 46, in combination with the display 18, may allow a user to control the handheld device 30B. For example, the input structure 40 may activate or deactivate the handheld device 30B, the input structure 42 may navigate a user interface to a home screen, a user-configurable application screen, and/or activate a voice-recognition feature of the handheld device 30B, the input structures 44 may provide volume control, and the input structure 46 may toggle between vibrate and ring modes. A microphone 48 may obtain a user's voice for various voice-related features, and a speaker 47 may enable audio playback and/or certain phone capabilities. A headphone input 49 may provide a connection to external speakers and/or headphones. As also noted above, to reduce artifacts and costs of high refresh rate content, the electronic device 10 (e.g., the display 18, the display interface 21, and/or the processor 12) may be equipped with the dynamic bandwidth control circuitry 21, and thereby may be used to control various aspects of content transmission to the display 18 based upon a refresh rate of the content.

Interface

Figure 5:
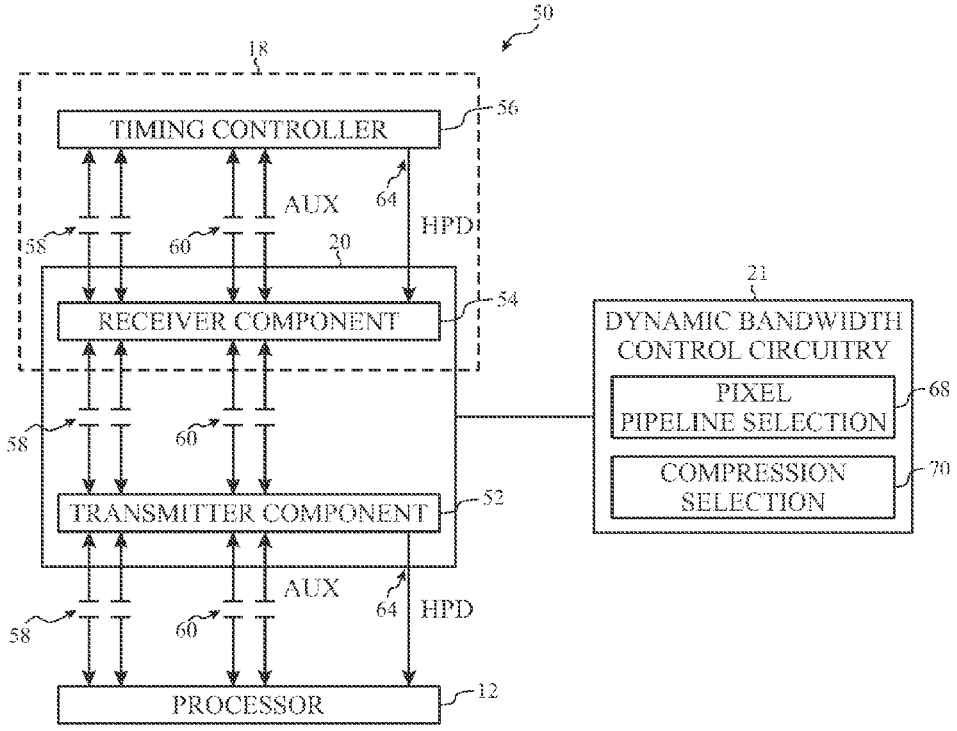
FIG. 5 is a circuit diagram of components of an electronic device, in accordance with present embodiments.

FIG. 5 illustrates a data communication system 50 that employs the interface 20 and dynamic bandwidth control circuitry 21 to facilitate communication between the processor 12 and the display 18. As shown in FIG. 5, the interface 20 may include a transmitter component 52 and a receiver component 54. In certain embodiments, the interface 20 may include a processor (e.g., the dynamic bandwidth control circuitry 21) or the like to control the operations of various components within the interface 20 such as the transmitter component 52 and the receiver component 54.

The transmitter component 52 may be communicatively coupled to the processor 12 and to the receiver component 54, and the receiver component 54 may be communicatively coupled to a timing controller 56 (TCON) of the display 18 and the transmitter component 52. The timing controller 56 may control the timing of when pixels, light emitting diodes (LEDs), or other display components in the display 18 may operate. As such, the timing controller 56 may receive image data or video data that may have originated at the processor 12, such that the image data or video data may indicate how the display components should operate.

In certain embodiments, the image data or video data may be routed to the timing controller 56 from the processor 12 via the interface 20. The image data or video data may be routed according to, for example, an Embedded DisplayPort (eDP) standard. However, it should be noted that the image data or video data may be routed to the timing controller 56 from the processor 12 using any other suitable display protocol.

When transmitting video data 58, the processor 12 may transmit video data 58 via a number of alternating current (AC) coupled differential pair cables (e.g., 4 micro-coaxial cables) to the transmitter component 42. In one embodiment, the video data 58 may include image data or video data that corresponds to the images or video to be depicted on the display 18. As such, the processor 12 may send the video data 58 via high-bandwidth communication mediums (e.g., four differential pair cables) that operate at, for example, 1.62 Gbps, 2.7 Gbps, 5.4 Gbps, or the like to ensure that the video data 58 is received by the transmitter component 42 in a timely manner. In one embodiment, the communication of the video data 58 to the transmitter component 52 may be unidirectional or transmitted from the processor 12 to the display 18, but not vice-versa.

In addition to the video data 58, the processor 12 may also send auxiliary data 60 to the transmitter component 52. The auxiliary data 60 may include sideband data that may be used for link training protocols, hand shaking protocols, control signals, clock signals, and the like. Generally, the auxiliary data 60 may originate from the processor 12 or the timing controller 56. As such, the auxiliary data 60 may be transmitted via a bi-directional communication medium (e.g., single bi-directional differential pair) to facilitate communication between the processor 12 and the timing controller 56, and vice-versa. In certain embodiments, the auxiliary data 60 may include a significantly smaller amount of data as compared to the video data 58 and thus may be communicated via an AC-coupled lower-bandwidth communication medium that operates at, for example, 1 Mbps or the like.

At some point during the transmission of the data 58 and/60 from the processor 12 to the timing controller 56 (and/or source driver 84 of FIG. 6), the dynamic bandwidth control circuitry 21 may modify one or more attributes of the image data 58 and/or auxiliary data 60 and/or one or more attributes of the transmission pipelines of the image data 58 and/or auxiliary data 60 between the processor 12 and one or more portions of the display 18. These modifications may be based upon a discerned refresh rate of the image data 58. As previously mentioned, artifacts (e.g., resulting from compression of image data) may be more easily detected in static images than moving frames. Accordingly, it may be desirable to implement compression for faster frames (e.g., image data with 120 Hz or higher) than slower frames (e.g., image data with 60 Hz or lower). For example, in some embodiments pixel pipeline selection circuitry 68 may determine and/or activate particular pipelines between the transmitter component 52 and the receiver component 54 for transmission of the image data 58 and/or auxiliary data 60. In some embodiments, compression selection circuitry 70 may determine whether or not compression should be applied to the image data 58 and/or auxiliary data 60 based upon the refresh rate of the image data 58.

Once the modifications are made to the pixel pipelines and/or data 58 and/or 60, the data 58 and/or 60 may be transmitted to the receiver component 54 (e.g., in a compressed format and/or via particularly selected and/or activated pixel pipelines, depending on the modifications made by the pixel pipeline selection circuitry 68 and/or the compression selection circuitry 70).

The receiver component 54 may, in turn, receive the transmitted data 58 and/or 60. If the data 58 and/or 60 was compressed by the dynamic bandwidth control circuitry 21 (e.g., the compression selection circuitry 70), then the receiver component 54 (or another component of the display 18 and/or interface 20 may decompress the compressed data, such that the decompressed data corresponds to the video data 58 and/or the auxiliary data 60 provided by the processor 12. The receiver component 54 may then transmit the video data 58 and/or the auxiliary data 60 to the timing controller 56, which may be used to control the operation of the display 18 to display images or video embedded within the video signal 58.

The timing controller 56 may also communicate with the processor 12 via the interface 20 in a similar manner as described above. That is, the timing controller 56 may transmit auxiliary data 60 and a Hot Plug Detection (HPD) signal 64 to the receiver component 54, which may be used to forward the auxiliary data 60 and the HPD signal 64 to the processor 12. The HPD signal 64 may provide an indication to the processor 12 that the display 18 is present and communicatively coupled to the processor 12. As such, the HPD signal 64 may be a uni-directional signal that may be transmitted from the timing controller 56 to the processor 12, but not vice-versa. In certain embodiments, the HPD signal 64 may pulse and provide an interrupt to the timing controller 56.

After receiving the auxiliary data 60 and the HPD signal 64 from the timing controller 56, the receiver component 54 may send the auxiliary data 60 and the HPD signal 64 to the transmitter component 52. The transmitter component 52 may receive the auxiliary data 60 and the HPD signal 64 provided by the timing controller 56. The transmitter component 52 may then transmit the auxiliary data 60 and the HPD signal 64 to the processor 12, thereby facilitating the communication between the timing controller 56 and the processor 12.

Figure 6:
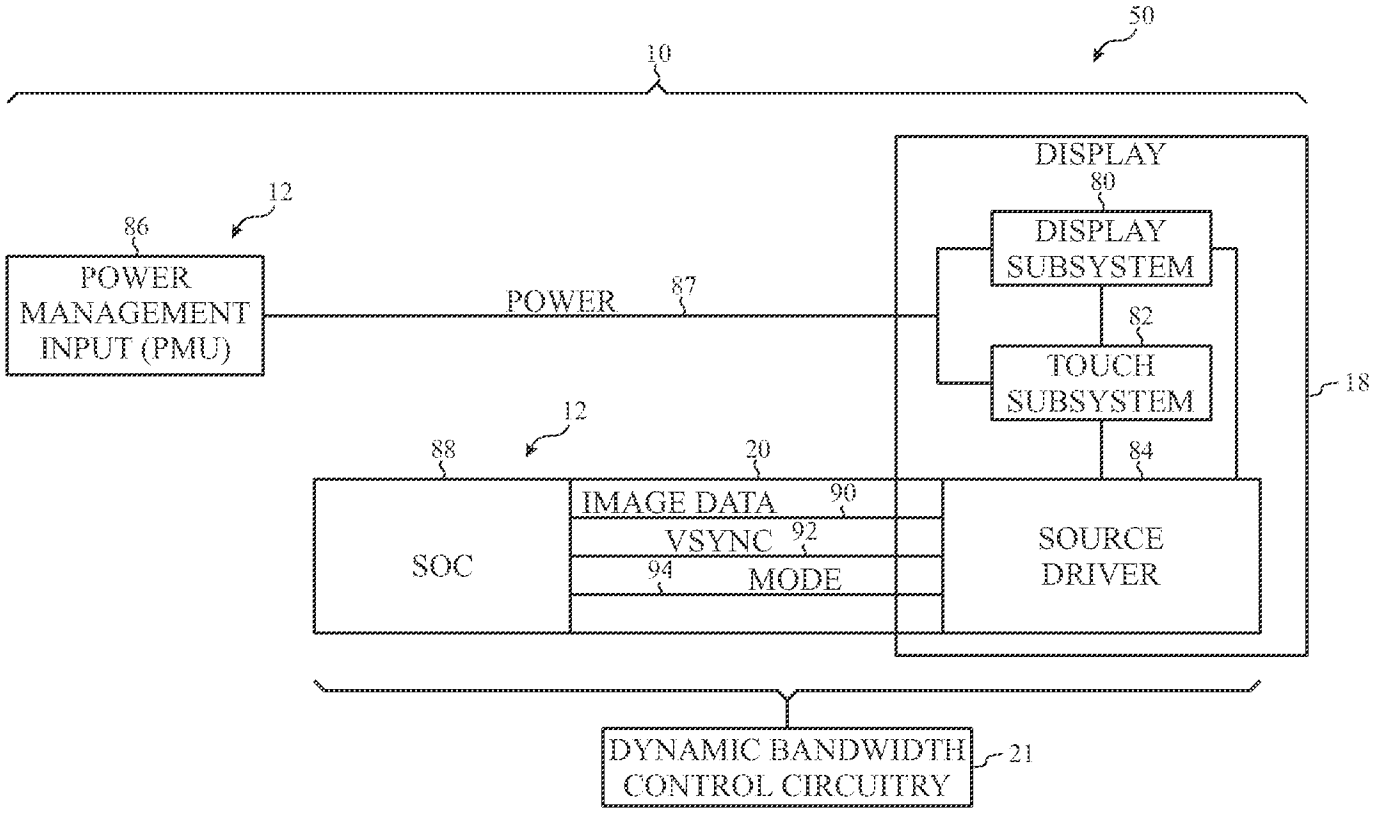
FIGS. 6 and 7 are a circuit diagram illustrating display circuitry of an electronic device, in accordance with present embodiments.

FIG. 6 is an embodiment of a circuit diagram of certain components of the electronic device 10 that may be used to control a dynamic bandwidth of content provided to the display 18. As illustrated, the electronic device 10 may include the display 18 and various processors 12. Specifically, the display 18 includes a display subsystem 80 and a touch subsystem 82. The display subsystem 80 is configured to receive and display image data, while the touch subsystem 82 is configured to sense touches of the display 18. In the present embodiment, a source driver 84 may be communicatively coupled to the display subsystem 80 and the touch subsystem 82.

As illustrated, the processors 12 may include a power management unit (PMU) 86 and a system on chip (SOC) 88. The PMU 86 may be used to manage the power of the electronic device 10, and may control when power is supplied to, and removed from, other components of the electronic device 10. For example, the PMU 86 may supply power 87 to the display 18. Specifically, the PMU 86 may supply power 87 to both the display subsystem 80 and the touch subsystem 82.

As illustrated, the SOC 88 provides image data 90 to the display 18. Furthermore, the SOC 88 provides a synchronization signal 92 (e.g., VSYNC) to the display 18 to cause the display 18 to refresh image data stored in pixels of the display 18. As may be appreciated, one or more of the image data 90, the synchronization signal 92, and the mode signal 94 may be provided from the SOC 88 to the display 18 via the interface 20 (e.g., a communication link (e.g., via a mobile industry processor interface (MIPI))).

As will be discussed in more detail below, the electronic device 10 may include dynamic bandwidth control circuitry 21. The dynamic bandwidth control circuitry 21 may be used to modify attributes (e.g., a selection of and/or activation) of the pixel pipelines used for transmission of image data 90 to the display subsystem 80 and/or modify attributes of the image data 90 itself to provide more efficient transmission of the image data 90. Thus, increased cost efficiencies and/or reduced image artifacts may be achieved. The dynamic bandwidth control circuitry 21 may be communicatively coupled to the SOC 88 and/or the source driver 84 to enable dynamic bandwidth allocation of data transmission between these components. Further, all and/or portions of the dynamic bandwidth control circuitry 21 may be part of the interface 20, the source driver 84, and/or a processor 12 (e.g., the SOC 88).

Figure 7:
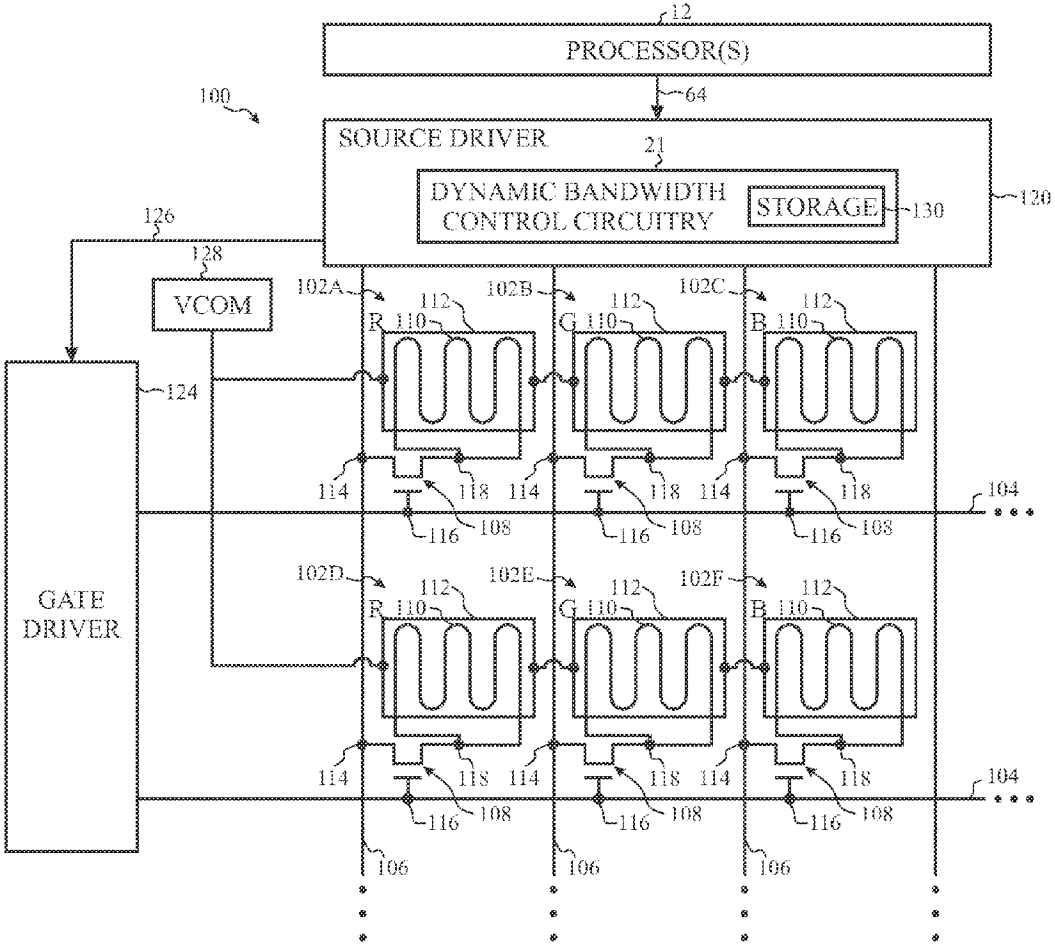

Turning now to a more detailed circuit view of the electronic display 18, FIG. 7 illustrates various components of an electronic display 18, including a pixel array 100. In particular, the pixel array 100 of the display 18 may include a number of unit pixels 102 disposed in a pixel array or matrix. In such an array, each unit pixel 102 may be defined by the intersection of rows and columns, represented by gate lines 104 (also referred to as scanning lines), and source lines 106 (also referred to as data lines), respectively. Although only six unit pixels 102, referred to individually by the reference numbers 102A-102F, respectively, are shown for purposes of simplicity, it should be understood that in an actual implementation, each source line 106 and gate line 104 may include hundreds or thousands of such unit pixels 102. Each of the unit pixels 102 may represent one of three subpixels that respectively filters only one color (e.g., red, blue, or green) of light. For purposes of the present disclosure, the terms "pixel," "subpixel," and "unit pixel" may be used largely interchangeably. Further, in certain embodiments, pixel data supplied to the pixels 102 of the display 18 may be considered a "frame" of pixel data.

In the presently illustrated embodiment, each unit pixel 102 includes a thin film transistor (TFT) 108 for switching a data signal supplied to a respective pixel electrode 110. The potential stored on the pixel electrode 110 relative to a potential of a common electrode 112, which may be shared by other pixels 102, may generate an electrical field sufficient to alter the arrangement of a liquid crystal layer of the display 18. In the depicted embodiment of FIG. 6, a source 114 of each TFT 108 may be electrically connected to a source line 106 and a gate 116 of each TFT 108 may be electrically connected to a gate line 104. A drain 118 of each TFT 108 may be electrically connected to a respective pixel electrode 110. Each TFT 108 may serve as a switching element that may be activated and deactivated for a period of time based on the respective presence or absence of a scanning or activation signal on the gate lines 104 that are applied to the gates 116 of the TFTs 108.

When activated, a TFT 108 may store the image signals (e.g., image data signal 90) received via the respective source line 106 as a charge upon its corresponding pixel electrode 110. As noted above, the image signals stored by the pixel electrode 110 may be used to generate an electrical field between the respective pixel electrode 110 and a common electrode 112. This electrical field may align the liquid crystal molecules within the liquid crystal layer to modulate light transmission through the pixel 102. Thus, as the electrical field changes, the amount of light passing through the pixel 102 may increase or decrease. In general, light may pass through the unit pixel 102 at an intensity corresponding to the applied voltage from the source line 106.

As discussed with regard to FIG. 6, the display 18 also may include a source driver integrated circuit (IC) 120, which may include a processor, microcontroller, or application specific integrated circuit (ASIC), that controls the display pixel array 100 by receiving image data 90 from the processor(s) 12 and sending corresponding image signals to the unit pixels 102 of the pixel array 100. It should be understood that the source driver 120 may be a chip-on-glass (COG) component on a TFT glass substrate, a component of a display flexible printed circuit (FPC), and/or a component of a printed circuit board (PCB) that is connected to the TFT glass substrate via the display FPC. Further, the source driver 120 may include any suitable article of manufacture having one or more tangible, computer-readable media for storing instructions that may be executed by the source driver 120. In addition, the source driver 120 may include and/or be communicatively coupled to the dynamic bandwidth control circuitry 21. In some embodiments, the dynamic bandwidth control circuitry 21 is not part of the source driver 120.

As discussed herein, the dynamic bandwidth control circuitry 21 may be useful to dynamically alter a selection of pixel pipelines used to supply pixel data to the source driver 120 or data supplied to a timing controller. Additionally or alternatively, the dynamic bandwidth control circuitry may be used to dynamically compress high-bandwidth content (e.g., content that has a refresh rate of over 60 Hz). Thus, using the dynamic bandwidth control circuitry 21, content may be served with multiple content refresh rates, while reducing artifacts and/or power consumption.

In certain embodiments, the dynamic bandwidth control circuitry 21 may store instructions in a storage device 130. The instructions may be used to control aspects of the image data 90 and/or pixel transmission pipeline activations between the processor 12 and the source driver 120. Such instructions may be based on a received indication of the image data 90 refresh rate, as described herein. As may be appreciated, the storage device 130 may be any suitable article of manufacture having a tangible, computer-readable media for storing instructions for the dynamic bandwidth control circuitry 21. For example, the storage device 130 may be an EEPROM device.

The source driver 120 also may couple to a gate driver integrated circuit (IC) 124 that may activate or deactivate rows of unit pixels 102 via the gate lines 104. As such, the source driver 120 may provide timing signals 126 to the gate driver 124 to facilitate the activation/deactivation of individual rows (i.e., lines) of pixels 102. In other embodiments, timing information may be provided to the gate driver 124 in some other manner. The display 18 may include a Vcom source 128 to provide a Vcom output to the common electrodes 112. In some embodiments, the Vcom source 128 may supply a different Vcom to different common electrodes 112 at different times. In other embodiments, the common electrodes 112 all may be maintained at the same potential (e.g., a ground potential) while the display 18 may be on.

Dynamic Pixel Pipeline Selection

Figure 8:
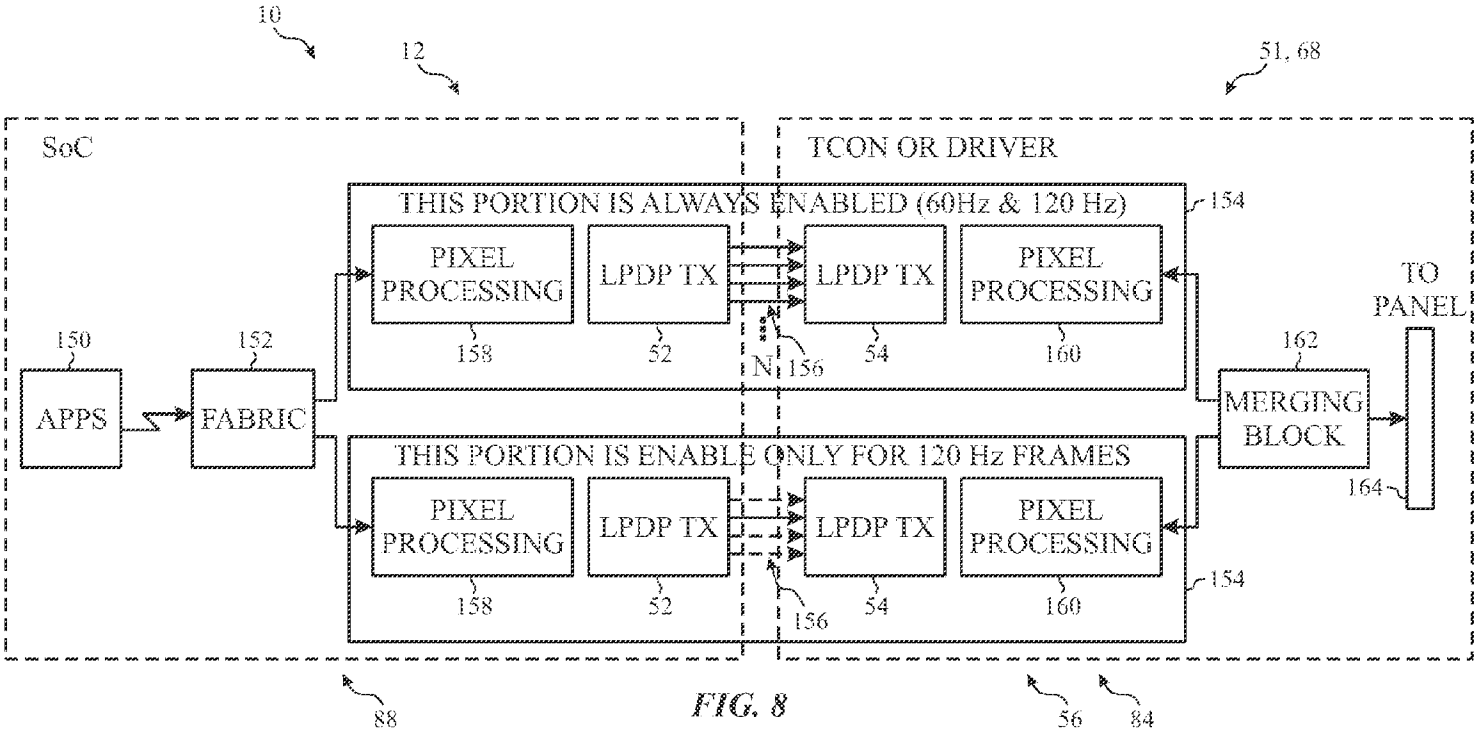
FIGS. 8 and 9 respectively illustrate a circuit diagram and flowchart for dynamic bandwidth control via dynamic processing pipeline selections, in accordance with a present embodiment.
Figure 9:
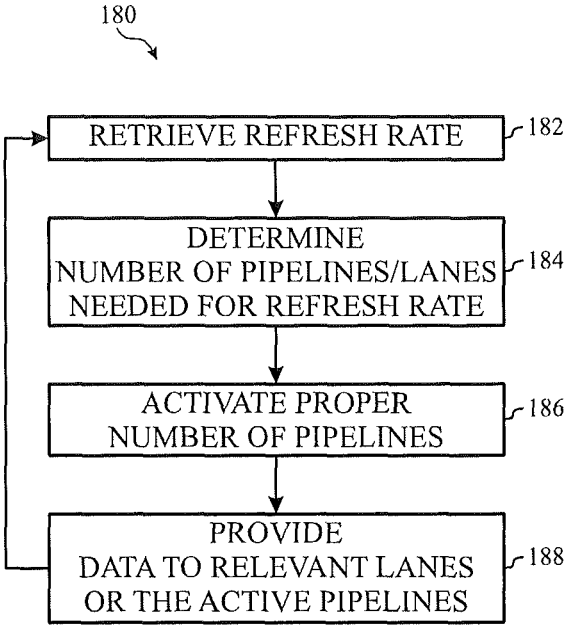

FIGS. 8 and 9 respectively illustrate a circuit diagram and flowchart for dynamic bandwidth control via dynamic processing pipeline selections, in accordance with a present embodiment. Specifically, FIG. 8 illustrates an embodiment of pixel pipeline selection circuitry 68 of the dynamic bandwidth control circuitry 21.

As illustrated in FIG. 8, one or more applications 150 may generate image data for an electronic display 18. The electronic display 18 may be equipped with the pixel pipeline selection circuitry 68, which may include a fabric 152, which receives image data from the applications 150. The fabric 152 may provide interconnection choices for the circuitry 68 by providing one or more interconnection networks and/or input/output elements to the circuitry 68. Accordingly, the fabric 152 may select one or more processing pipelines 154 and/or one or more processing lanes 156 useful for processing the image data. For example, as will be discussed in more detail with regard to FIG. 9, in some embodiments, more pipelines 154 and/or lanes 156 may be used at higher bandwidths (e.g., one pipeline 154 for a first frame rate (e.g., 60 Hz) and first and second pipelines 154 for a second, higher frame rate (e.g., 120 Hz)). As illustrated, the processing pipelines 154 may include multiple processing lanes 156 (e.g., 4 in the illustrated embodiment), which may be transmission wires between transmission components 52 and receiver components 54. Accordingly, when a particular pipeline 154 is activated, the active lanes 156 within the pipeline 154 may transmit data to the timing controller 56 and/or source driver 84. Prior to transmitting the data, initial pixel processing may occur at pixel processing block 158. Additionally, after the data is received at the receiver 54, subsequent pixel processing may occur at pixel processing block 160. Upon completion of the transfer to the timing controller 56 and/or source driver 84 via the one or more pipelines 154 and lanes 156, a merging block 162 may combine the pieces of data that were directed to the one or more various pipelines 154 by the fabric 152. The reconstructed data is then provided for display at the display panel 164.

FIG. 9 illustrates a process 180 for dynamic bandwidth control, in accordance with an embodiment. The process 180 begins by retrieving the refresh rate of content supplied to the display 18 (block 182). For example, the refresh rate may be decoded from the supplied content. In some embodiments, an application may specify the refresh rate or the refresh rate may be measured based upon the rate at which an application generates frames. Next, a determination is made as to the number of pipelines 154 and lanes 156 within those pipelines 154 that should be used to transmit the data to the timing controller 56 and/or source driver 84. The higher the refresh rate, the more pipelines 154 and/or lanes 156 may be used to transfer the data. For example, as may be appreciated, 120 Hz content may use double the bandwidth of 60 Hz. Accordingly, in embodiments where one pipeline may be used to supply 60 Hz content, the number of active pipelines may be doubled to two, to transmit 120 Hz content.

Further, the number of lanes 156 may be interpolated based upon one or more thresholds, the number of lanes 156 within a pipeline 154, etc. For example, the number of lanes 156 within the pipelines may be reduced when less than full pipeline 158 bandwidth in needed. For example, in the embodiment of FIG. 8, the pipelines 154 each include four lanes 156. In alternative embodiments the number of lanes may be different and may vary among the pipelines 154. If the embodied pipeline with four lanes is optimally used to transmit 60 Hz content, then each lane may optimally configure ¼ of the 60 Hz content. In some situations, it may be desirable to de-activate certain lanes when the received content has a refresh rate that is lower than 60 Hz. For example, when the content has a refresh rate of 45 Hz, a lane 156 may be disabled, resulting in a single pipeline with three active lanes 156. When the received content's refresh rate is above 60 Hz, an additional pipeline 154 may be activated and one or more of the lanes 156 within that pipeline 154 may be activated. For example, when the content's refresh rate is 66 Hz, an additional pipeline 154 and one lane 156 within that pipeline may be activated. When the content's refresh rate exceeds 75 Hz, a second lane 156 may be activated, etc. In some embodiments, an all or nothing approach may be used to activate the lanes 156. In such embodiments, whenever a pipeline 154 is activated, all of lanes 156 within that pipeline are activated. When a pipeline is de-activated, all of the lanes 156 within that pipeline 154 are de-activated.

Once the number of pipelines 154 and/or lanes 156 are determined, the proper number of pipelines 154 and/or lanes 156 are activated (e.g., by interconnection/rerouting in the fabric 152) (block 186). From there the data is presented to the display panel 164, via the proper pipelines 154 and/or proper lanes 156 (block 188). The process 180 may begin again and continue until there is no more data to be displayed at the display 18.

Figure 10:
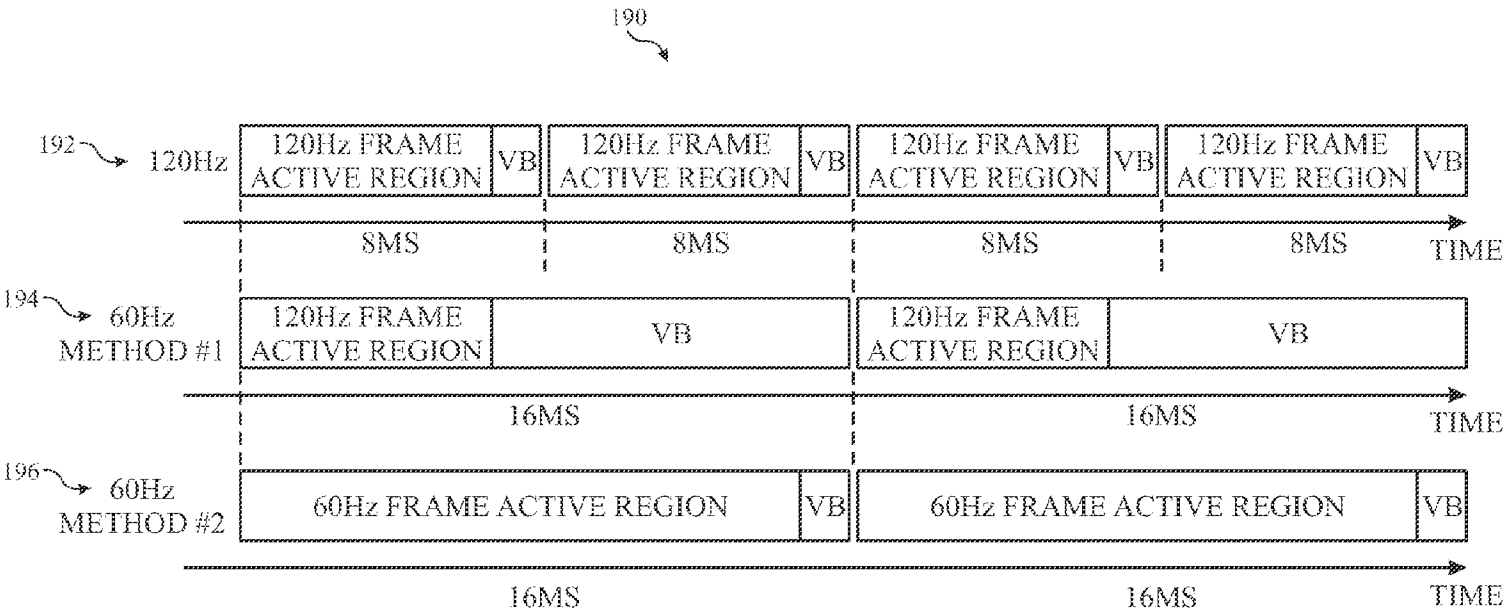
FIG. 10 illustrates a timing diagram that compares timings of high-speed content painting, lower-speed content painting using the same number of ports and/or pipelines as the high-speed content, and lower-speed content painting using fewer ports and/or pipelines, in accordance with one or more embodiments.

Using the above process 180 and circuitry 68, a more granular decision may be made regarding the number of pipelines 154 and/or lanes 156 to use for particular refresh rates. This may result in increased efficiencies, such as power-consumption efficiencies, etc. FIG. 10 illustrates a timing diagram 190 that compares timings of high-speed content (e.g. 120 Hz content) painting 192, lower-speed content (e.g., 60 Hz content) painting 194 using the same number of ports and/or pipelines as the high-speed content, and lower-speed content (e.g., 60 Hz content) painting 196 using fewer ports and/or pipelines.

Referring back to the 120 Hz content rendering example in FIG. 8, when the high-speed content (e.g., 120 Hz content) is rendered, an additional pipeline 154 is activated. Thus, as illustrated in FIG. 10, 120 Hz painting 192 may result in a new 120 Hz active frame region and vertical blanking period every 8 milliseconds.

In contrast, if the same number of pipelines were active for the processing of lower-speed content (e.g., 60 Hz content), the frame would be extended using a larger vertical blanking window, as illustrated in painting 194. For example, the vertical blanking period of the painting 194 may replace the 120 Hz active frame region of the second 8 milliseconds of each 16 milliseconds of painting 192.

In embodiments where an additional pipeline is activated for painting 192 high-speed content (e.g., 120 Hz content), but not painting 196 lower-speed content (e.g., 60 Hz content) the active frame region may be extended, painting at a 60 Hz active frame region rate. This results in a relatively small vertical blanking period and an extended active frame region timing as compared to painting 194 using the 120 Hz active frame region timing.

Dynamic Compression/Decompression

Figure 11:
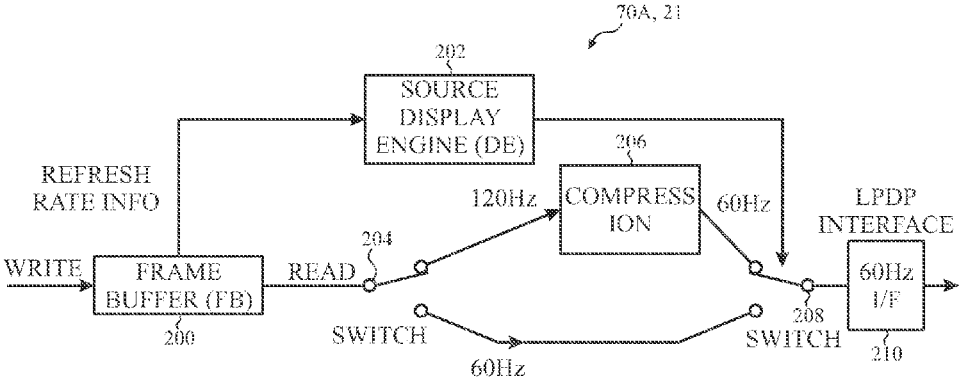
FIGS. 11 and 12 respectively illustrate a circuit diagram and flowchart for dynamic bandwidth control via dynamic compression, in accordance with a present embodiment.
Figure 12:
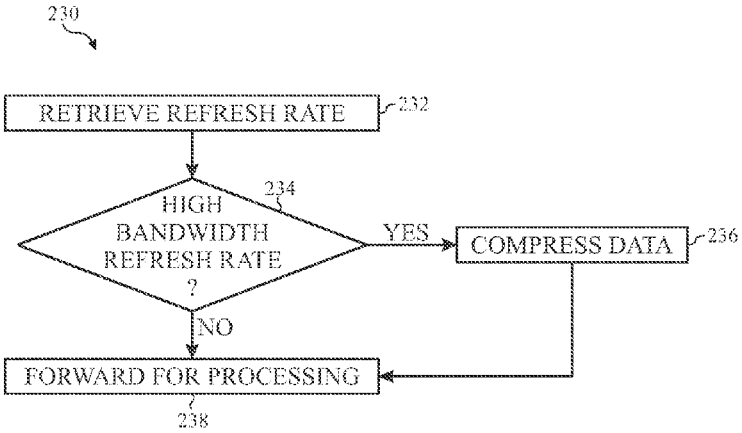
Figure 13:
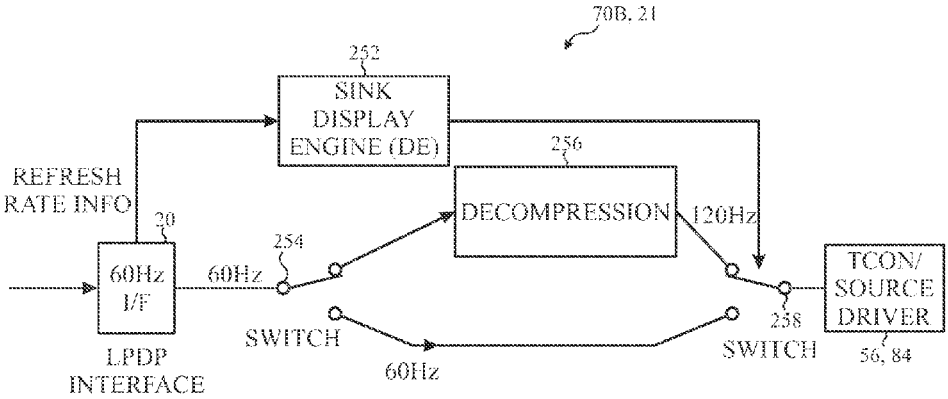
FIGS. 13 and 14 respectively illustrate a circuit diagram and flowchart for displaying dynamically bandwidth-controlled content via dynamic de-compression, in accordance with a present embodiment.
Figure 14:
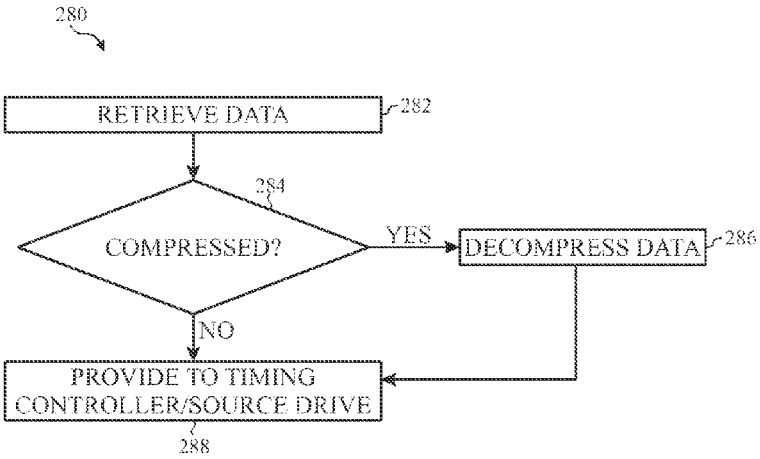

Another way to dynamically control bandwidth allocation is to compress data. For example, lossy compression, color-subsampling, reduced color-depth ranges, etc. may be used to reduce an amount of data that is transferred between the SOC 88 and the timing controller 56 and/or source driver 84. FIGS. 11 and 12 respectively illustrate a circuit diagram 199 and flowchart 230 for dynamic bandwidth control via dynamic compression, in accordance with a present embodiment. Specifically, FIG. 11 illustrates a first, source portion 70A of the compression selection circuitry 70 of FIG. 5. FIG. 12 illustrates a process 230 for selectively compressing data based upon refresh rate, in accordance with an embodiment. FIG. 13 illustrates a second, sink portion 70B of the compression selection circuitry 70 and FIG. 14 illustrates a process 280 for selectively decompressing data based upon refresh rate, in accordance with one or more embodiments.

Starting first with FIG. 11, an embodiment of a source portion 70A of the compression selection circuitry 70 is illustrated. As data is written to the source portion 70A, a frame buffer 200 read operation is used to determine the speed of the written data. For example, the data may be clocked at either 120 Hz or 60 Hz frame rates. The frame buffer 200 supports any clock rates expected to be written for display at the display 18 (e.g., written to the source portion 70A). The refresh rate information is provided to a source display engine (DE) 202, which sets a switch 204 to either compress the content or leave the content in an uncompressed state. As mentioned herein, compression artifacts may be more visible in slower content. Accordingly, the source display engine 202 may make a determination as to whether or not the content is to be compressed based upon a threshold refresh rate. For example, the source display engine 202 may compress content with a refresh rate that is above 60 Hz or may compress content that is at 120 Hz, for example. When the refresh rate information indicates that content is to be compressed, the source display engine 202 may actuate the switch 204 to activate a compression pathway having compression circuitry 206, where the content is compressed. When the refresh rate does not indicate that compression is to occur, the source display engine 202 may actuate the switch 204 to a non-compression pathway.

The source display engine 202 may also actuate a switch 208 at the end of the compression and non-compression pathways. When the refresh rate indicates that compression is to be used, the switch 208 may be actuated to receive data from the compression pathway (e.g., compressed data from the compression circuitry 206). Further, when the refresh rate indicates that compression is not to be implemented, the source display engine 202 may actuate the switch to receive data from the non-compression pathway (e.g., un-compressed image data).

The data may then be received from the proper pathway, and provided to the display interface 20 (e.g., a low-power display port (LPDP) interface). Because the higher-speed content (e.g., 120 Hz content) is now compressed, the interface 20 may support lower-refresh rate transmission (e.g., 60 Hz).

Discussing now the process 230 using a 120 Hz compression threshold example, 120 Hz content may be written to the frame buffer 200. The 120 Hz refresh rate may be obtained (e.g., by a frame buffer read operation) (block 232). The refresh rate information is used to determine if the refresh rate is high enough for compression (decision block 234). For example, if the source display engine 202 is set to compress data that has a refresh rate of 120 Hz or higher, the threshold is met for compressing the data. Thus, the data is compressed (e.g., by setting the switches 204 and 208 to activate the compression pathway containing compression circuitry 206 (block 236). Once the compression is complete or if the refresh rate does not warrant compression (e.g., does not reach the compression refresh rate threshold), the data is provided for further processing (e.g., provided to the interface 20) for further transmission.

For example, as illustrated in FIG. 13, the content may be received at portion 70B of the dynamic bandwidth control circuitry 21. As illustrated, the interface 20 (e.g., a low-power display port (LPDP) interface) may receive the content and provide refresh rate information to a sink display engine 252, which may control whether or not a switch 254 is actuated to enable decompression of the content via the decompression circuitry 256. For example, if the refresh rate information indicates that the content was previously compressed, the switch 254 may be actuated to pass the content to the decompression circuitry 256. When the refresh rate information indicates that the content was not compressed, the switch 254 may be actuated to bypass the decompression circuitry 256. The sink display engine 252 may also control a second switch 258 that determines whether or not to receive content from the decompression 256 circuitry or a bypass pathway. For instance, when switch 254 is actuated to compress the content, the switch 258 may be actuated to receive content from the decompression circuitry 256. When the decompression circuitry 256 is bypassed, the switch 258 may be actuated to receive content from the bypass pathway. The content may be passed by the switch 258 to a timing controller 56 and/or source driver 84.

FIG. 14 illustrates a process 280 for decompressing dynamically compressed data, in accordance with an embodiment. The process 280 begins by retrieving the data (block 282). As mentioned above, the interface 20 may receive compressed or decompressed content (e.g., from portion 70A of FIG. 10). A determination is made as to whether the content is compressed or not (decision block 284). For example, as discussed above, the refresh rate may be interpreted to determine whether or not content was previously compressed. Additionally or alternatively, in some embodiments a flag may indicate the refresh rate of the content and/or whether the content was previously compressed.

If the content was compressed, the content is decompressed (block 256). As discussed above, this may occur, in some embodiments, by actuating a switch to route the content to decompression circuitry. Once decompression is complete or no previous compression occurred, the content is provided to the timing controller 56 and/or source driver 84 (block 288).

Though the current embodiment bases compression and/or decompression on refresh rate information, in some embodiments, other information (e.g., flags, etc.) may be used to control the switches. Accordingly, in some embodiments, the refresh rate of the content does not need to be observed at portion 70A of FIG. 11, portion 70B of FIG. 13, or both.

Figure 15:
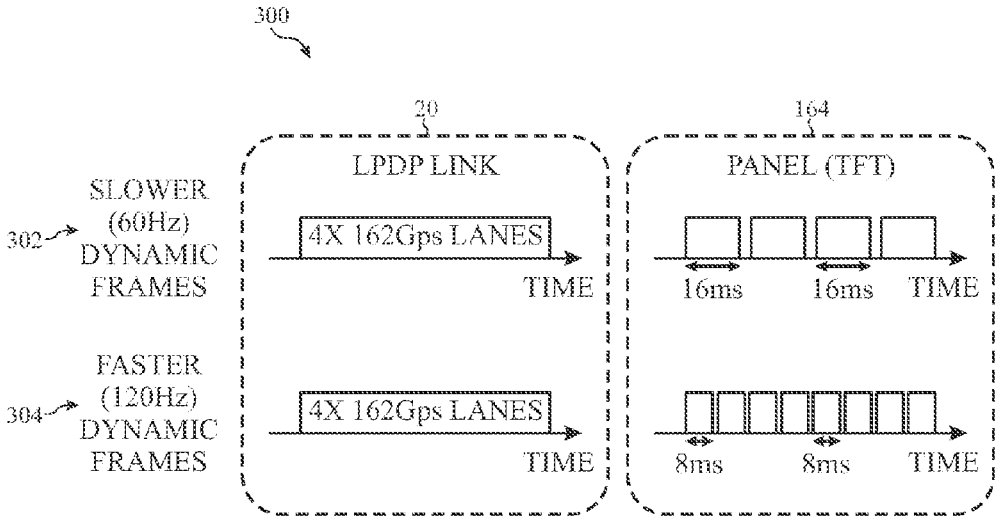
FIG. 15 illustrates a time-based comparison of transmitted content that is compressed versus content that is not compressed, in accordance with one or more embodiments.

By using the dynamic compression described herein, increased bandwidth may be provided for faster content, while retaining the same data transmission rate. For example, FIG. 15 illustrates a time-based comparison 300 of transmitted content that is compressed versus content that is not compressed. In the example of FIG. 15, slower content (e.g., 60 Hz content) is processed and rendered as illustrated in row 302. The faster content (e.g., 120 Hz content) is processed and rendered as illustrated in row 304. As illustrated in row 302, the interface 20 link rate is the number of lanes times the throughput per lane. In the current example, four lanes are used, where each lane has a throughput of 1.62 Gbps. Accordingly, the link rate of the interface 20 is 4×1.62 Gbps. Further, for the slower content, because there is no compression, the content is rendered by the panel 164 at a standard frame rate of 1 frame ever 16 milliseconds.

As illustrated in row 304, for faster content, the interface 20 link rate is equal to the link rate in row 302. As mentioned above, the link rate is the number of lanes times the throughput of each of the lanes. Accordingly, similar to row 302, the link rate is 4×1.62 Gbps. However, in contrast to the slower content, which is uncompressed, the faster content may be compressed. Accordingly, the content may be rendered by the panel 164 faster (e.g., two 120 Hz frames may be compressed into 16.7 milliseconds). Thus, roughly double the amount of frames may be rendered in a substantially similar amount of time.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A method comprising:

receiving a refresh rate for content to be displayed on an electronic display;

determining, based upon the refresh rate:

a number of pixel pipelines of an interface, each of the pixel pipelines comprising pixel processing circuitry that performs pixel processing of received pixel data; and a number of lanes within each of the number of pixel pipelines of the interface, the number of lanes each comprising a transmission wire to transfer at least a portion of the received pixel data to, from or to and from the pixel processing circuitry to activate;

activating the number of pixel pipelines and the number of lanes; and providing the content for rendering at a display panel via the number of pixel pipelines and the number of lanes that are activated.

2. The method of claim 1, wherein receiving the refresh rate comprises:

receiving the content and decoding the refresh rate from the content that is received.

3. The method of claim 1, wherein determining the number of pixel pipelines comprises:

when the refresh rate is approximately 60 Hz, determining the number of pixel pipelines to equal 1; and when the refresh rate is approximately 120 Hz, determining the number of pixel pipelines to equal 2.

4. The method of claim 1, wherein determining the number of lanes comprises multiplying the number of pipelines by a number of lanes in a pipeline.

5. The method of claim 1, wherein determining the number of lanes comprises interpolating a number of lanes based upon the refresh rate.

6. The method of claim 1, comprising merging outputs from the pipelines that are activated prior to providing the content for rendering at the display panel.

7. An electronic device, comprising:

a processor, configured to generate image data;

an electronic display, configured to render the image data;

an interface, configured to provide the image data transmitted from the processor to the electronic display; and dynamic bandwidth control circuitry configured to:

determine a refresh rate of the image data;

determine, based upon the refresh rate:

a number of pixel pipelines of the interface, each of the pixel pipelines comprising pixel processing circuitry that performs pixel processing of received pixel data; and a number of lanes within each of the number of pixel pipelines of the interface, the number of lanes each comprising a transmission wire to transfer at least a portion of the received pixel data to, from or to and from the pixel processing circuitry to activate;

activate the number of pixel pipelines and the number of lanes; and provide the image data for rendering at the electronic display via the number of pixel pipelines and number of lanes that are activated.

8. The electronic device of claim 7, wherein the electronic display comprises a timing controller and the dynamic bandwidth control is configured to provide the image data to the timing controller.

9. The electronic device of claim 7, wherein the electronic display comprises a source driver and the dynamic bandwidth control is configured to provide the image data to the source driver.

10. The electronic device of claim 7, wherein the dynamic bandwidth control circuitry is configured to activate one pixel pipeline when the refresh rate is 60 Hz and activate two pixel pipelines when the refresh rate is 120 Hz.

11. The electronic device of claim 10, wherein the number of lanes equals a number of activated pipelines multiplied by a number of lanes in each pixel pipeline.

12. The electronic device of claim 10, wherein the number of lanes is less than a number of activated pipelines multiplied by a number of lanes in each pixel pipeline.

13. The electronic device of claim 7, wherein the interface comprises a low-power display port (LPDP) interface.

14. The electronic device of claim 7, wherein the interface comprises at least a portion of the dynamic bandwidth control circuitry.

15. The electronic device of claim 7, wherein the processor comprises at least a portion of the dynamic bandwidth control circuitry.

16. The electronic device of claim 7, wherein the electronic display comprises at least a portion of the dynamic bandwidth control circuitry.

17. The electronic device of claim 7, wherein the dynamic bandwidth control circuitry configured to:

determine, based upon the refresh rate of the image data, whether or not the image data should be compressed;

selectively compress the image data when the image data should be compressed; and subsequently provide the image data for rendering at a display panel.

18. A method, comprising:

decoding a refresh rate for content to be displayed on an electronic display;

determining, based upon the refresh rate:

a number of pixel pipelines for transmission of the content, each of the pixel pipelines comprising pixel processing circuitry that performs pixel processing of received pixel data;

a number of lanes within each of the number of pixel pipelines of the interface, the number of lanes each comprising a transmission wire to transfer at least a portion of the received pixel data to, from or to and from the pixel processing circuitry to activate; and whether or not the content should be compressed from the content;

selectively compressing the content when the content should be compressed; and subsequently providing the content for rendering at a display panel by activating and using the number of pixel pipelines and the number of lanes.

19. The method of claim 18, wherein determining whether or not the content should be compressed, comprises:

determining that the content should be compressed if the refresh rate is greater than or equal to a refresh rate threshold; and otherwise, determining that the content should not be compressed.

20. The method of claim 19, wherein the refresh rate threshold is 120 Hz.

21. The method of claim 18, wherein determining whether or not the content should be compressed, comprises:

determining that the content should not be compressed if the refresh rate is less than or equal to a refresh rate threshold; and otherwise, determining that the content should be compressed.

22. The method of claim 21, wherein the refresh rate threshold is 60 Hz.

23. An electronic device, comprising:

a processor, configured to generate image data;

an electronic display, configured to render the image data;

a display interface, configured to provide image data transmitted from the processor to the electronic display; and dynamic bandwidth control circuitry configured to:

determine, based upon a refresh rate of the image data:

a number of pixel pipelines for transmission of the content, each of the pixel pipelines comprising pixel processing circuitry that performs pixel processing of received pixel data;

a number of lanes within each of the number of pixel pipelines of the interface, the number of lanes each comprising a transmission wire to transfer at least a portion of the received pixel data to, from or to and from the pixel processing circuitry to activate; and whether or not the image data should be compressed;

selectively compress the image data when the image data should be compressed; and subsequently provide the image data for rendering at a display panel by activating and using the number of pixel pipelines and the number of lanes.

24. The electronic device of claim 23, wherein the dynamic bandwidth control circuitry comprises:

a frame buffer configured to receive the image data;

a source display engine configured to determine the refresh rate from information provided by the frame buffer;

a first switch configured to:

route the image data to a compression pathway when the image data should be compressed; and route the image data to a bypass pathway bypassing compression when the image data should not be compressed;

a second switch configured to:

route the image data to the display interface from the compression pathway when the image data should be compressed; and route the image data to the display interface from the bypass pathway when the image data should not be compressed.

25. The electronic device of claim 24, wherein the frame buffer supports a 120 Hz refresh rate and the display interface supports a 60 Hz refresh rate.

26. The electronic device of claim 23, wherein the dynamic bandwidth control circuitry comprises:

a first switch configured to:

route the image data to a decompression pathway when the image data should be compressed; and route the image data to a bypass pathway bypassing the decompression pathway when the image data should not be compressed;

a second switch configured to:

route the image data to a timing controller, a source driver, or both of an electronic display from the decompression pathway when the image data should be compressed; and route the image data to the timing controller, the source driver, or both from the bypass pathway when the image data should not be compressed; and a sink display engine configured to control the first switch and the second switch based upon whether or not the image data should be compressed.

27. The electronic device of claim 26, wherein the sink display engine is configured to control the first switch and the second switch based upon a refresh rate of the image data.

28. The electronic device of claim 26, wherein the sink display engine is configured to control the first switch and the second switch based upon a flag provided with the image data.

29. The electronic device of claim 26, wherein the display interface supports a 60 Hz refresh rate and the timing controller, the source driver, or both support a 120 Hz refresh rate.

* * * * *